United States Patent [19]

Anderson

[11] Patent Number: 4,912,421

[45] Date of Patent: Mar. 27, 1990

[54] VARIABLE ENERGY CONSTANT CURRENT ACCELERATOR STRUCTURE

[75] Inventor: Oscar A. Anderson, Berkeley, Calif.

[73] Assignee: The United States of America as represented by the United States Department of Energy, Washington, D.C.

[21] Appl. No.: 218,390

[22] Filed: Jul. 13, 1988

[51] Int. Cl.[4] ..... H05H 5/00

[52] U.S. Cl. ..... 328/233; 313/360.1; 313/361.1

[58] Field of Search ..... 328/233; 313/360.1, 313/361.1

[56] References Cited

U.S. PATENT DOCUMENTS 2,182,185 12/1939 Trump ..... 313/360.1 X
3,376,449 4/1968 Harrison ..... 313/361.1 X

FOREIGN PATENT DOCUMENTS 1051428 2/1959 Fed. Rep. of Germany ... 313/360.1

OTHER PUBLICATIONS

"Transformer Type Accelerators for Intense Electron Beams" by E. A. Abramyan, *IEEE Transactions on Nuclear Science*, vol. NS-18, 1971, pp. 447-455.

"A High-Current Accelerator that Products 1.2 MeV Protons" by Abramyan et al, translated from *Atomnaya Energiya*, vol. 29, No. 5, pp. 346-351.

"A Transverse-Field-Focussing (TFF) Accelerator for Intense Ribbon Beams" by Anderson et al, *IEEE Transactions on Nuclear Science*, vol. NS-30, No. 4, Aug. 1983, pp. 3215-3217.

"Design of a 200 mA DC H− Injector for an RFQ" by Anderson et al, published as LBL-22259 and presented at the proceedings of the 1987 Particle Accelerator Conf. in Wash., D.C., Mar. 16-19, 1987, 3 pages.

"Overview and Status of the Transverse-Field Focusing (TFF) Accelerator" by Anderson et al, published *LBL*-19593 and presented at the 1985 Particle Accelerator Conf. in Vancouver, B.C., Canada, May 13-16, pp. 1-3.

"Optimization of H− Production in a Magnetically Filtered Multicusp Source" by Leung et al, *Review of Scientific Instruments*, 56(3), Mar. 1985, pp. 364-368.

"Self-Extraction Negative Ion Source" by Leung et al, *Review of Scientific Instruments*, 53(6), Jun. 1982, pp. 803-809.

"Accelerator and Transport Systems for High-Current Negative Ion Beams" by O. A. Anderson et al, paper presented at the IAEA Technical Committee Meeting on Negative Ion Beam Heating at Culham Lab., Jul. 15-17, 1987, 27 pages.

*Primary Examiner*—Palmer C. DeMeo

*Attorney, Agent, or Firm*—Clifton E. Clouse, Jr.; Roger S. Gaither; William R. Moser

[57] ABSTRACT

A variable energy, constant current ion beam accelerator structure is disclosed comprising an ion source capable of providing the desired ions, a pre-accelerator for establishing an initial energy level, a matching/pumping module having means for focusing means for maintaining the beam current, and at least one main accelerator module for continuing beam focus, with means capable of variably imparting acceleration to the beam so that a constant beam output current is maintained independent of the variable output energy. In a preferred embodiment, quadrupole electrodes are provided in both the matching/pumping module and the one or more accelerator modules, and are formed using four opposing cylinder electrodes which extend parallel to the beam axis and are spaced around the beam at 90° intervals with opposing electrodes maintained at the same potential. Adjacent cylinder electrodes of the quadrupole structure are maintained at different potentials to thereby reshape the cross section of the charged particle beam to an ellipse in cross section at the mid point along each quadrupole electrode unit in the accelerator modules. The beam is maintained in focus by alternating the major axis of the ellipse along the x and y axis respectively at adjacent quadrupoles. In another embodiment, electrostatic ring electrodes may be utilized instead of the quadrupole electrodes.

14 Claims, 9 Drawing Sheets

2/9

VARIABLE ENERGY CONSTANT CURRENT ACCELERATOR STRUCTURE

BACKGROUND OF THE INVENTION

The invention described herein arose in the course of, or under, Contract No. DE-AC03-76SF00098 between the United States Department of Energy and the University of California.

Variable beam energy at constant current is required for various applications such as, for example, neutral injection in fusion reactors, where the beam energy should be reduced during the start-up phase; and ion implantation in semiconductors, where control of the depth of the implantation or penetration through masking layers over the area to be implanted may be important.

Although beam accelerator transport systems are well known in the prior art, some of these systems suffer from internal breakdown problems and provide only fixed output levels which are clearly unsuited for many applications. Attempts to vary output energy invariably result in severe variations in output current.

Furthermore, for high current applications. e.g., to maintain a 200 milliampere current for an H- beam channel at an energy level of from, for example, 1 to 2 MeV, it would be necessary to space conventional electrodes close together which could, in turn, cause sparking between electrodes at such high voltages.

The use of transverse field focusing of a high power ion beam, e.g. 400–800 keV, in the form of a ribbon or sheet beam has been previously discussed in a publication entitled "A Transverse-Field-Focusing (TFF) Accelerator for Intense Ribbon Beams", by Anderson et al, published in the IEEE Transactions on Nuclear Physics, Vol. NS-30, No. 4, in August, 1983 at pp 3215–3217; and in a paper entitled "Overview and Status of the Transverse-Field Focusing (TFF) Accelerator", presented at the 1985 Particle Accelerator Conference in Vancouver, B.C., Canada in May, 1985, and published by the Lawrence Berkeley Laboratories as LBL-19593. A TFF Accelerator is described in these publications in which a transverse electric field is set up between pairs of curved deflecting plates. Charged particles passing between the plates are both deflected and strongly focused by the field. Average-straight-line motion (if desired) is obtainable by having the successive pairs of plates curve in alternating directions with corresponding reversal of the field. Acceleration is achieved by adjusting the mean voltage on each succeeding pair of plates.

However, there remains a need for a variable energy, constant current accelerator structure for a pencil-like ion beam which structure would be capable of reliable, conservative operation and free from internal voltage breakdown, and which may be used to produce a high power ion beam.

SUMMARY OF THE INVENTION

It is, therefore, an object of this invention to provide a variable energy, constant current ion beam accelerator structure using one or more modular beam accelerating units which maintain the focus of the beam at constant current while accelerating the beam.

It is another object of this invention to provide a variable energy, constant current ion beam accelerator structure comprising an ion source capable of providing the desired ions, a pre-accelerator for establishing an initial energy level, a matching/pumping module having means for focusing and means for maintaining the beam current, and at least one main accelerator module for continuing beam focus, with means capable of variably imparting acceleration to the beam so that a constant beam output current is maintained independent of the variable output energy.

It is yet another object of this invention to provide a variable energy, constant current ion beam accelerator structure comprising an ion source capable of providing the desired ions, a pre-accelerator for establishing an initial energy level, a matching/pumping module having means for focusing and means for maintaining the beam current, and at least one main accelerator module for continuing beam focus, with electrostatic quadrupole electrode means capable of variably imparting acceleration to the beam so that a constant beam output current is maintained independent of the variable output energy.

It is still another object of this invention to provide a variable energy, constant current ion beam accelerator structure comprising an ion source capable of providing the desired ions, a pre-accelerator for establishing an initial energy level, a matching/pumping module having means for focusing means for maintaining the beam current, and at least one main accelerator module for continuing beam focus, with electrostatic ring electrode means capable of variably imparting acceleration to the beam so that a constant beam output current is maintained independent of the variable output energy.

These and other objects of the invention will be apparent from the following description and accompanying drawings.

DETAILED DESCRIPTION OF THE INVENTION

Figure 1:
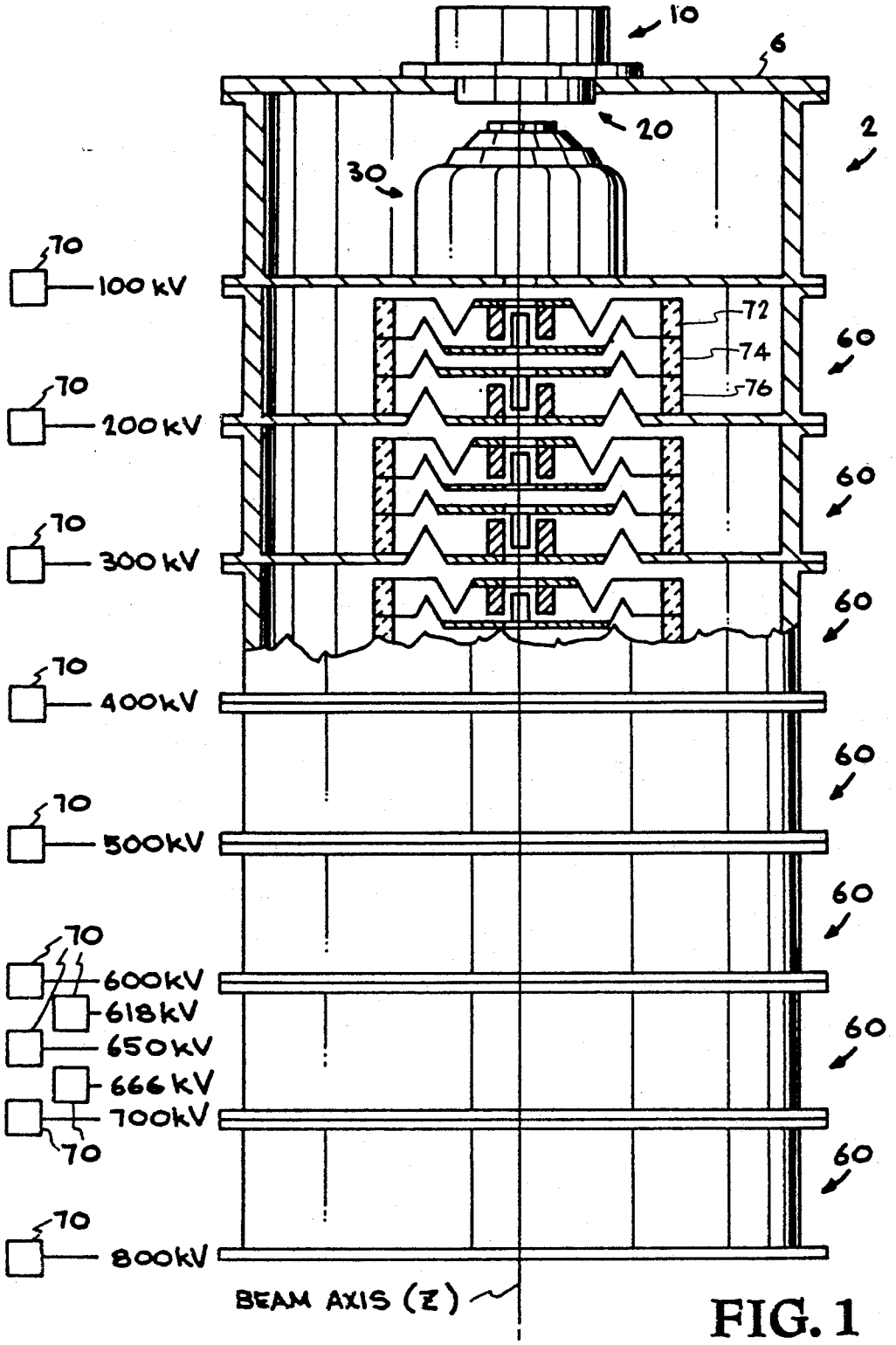
FIG. 1 is a vertical cross-section view of a preferred embodiment of the variable energy accelerator of the invention constructed using electrostatic quadrupole focusing and accelerating electrodes.

A preferred embodiment of the variable energy constant current ion beam accelerator structure of the invention is generally indicated at 2 in FIG. 1. Accelerator structure 2 comprises a vacuum-tight cylindrical housing 6, consisting of a series of concentric cylinders sealed to one another, and to which is secured an ion source 10. Within housing 6, and coaxially aligned with ion source 10, are a pre-accelerator module 20, a matching/pumping module 30, and one or more accelerator units or modules 60.

Ion source 10 is not shown in detail since such are known in the prior art and described, for example, in publications such as Leung et al, "Optimization of $H^-$ Production in a Magnetically Filtered Multicusp Source", Rev. Sci. Instrum. 56, 364 (1985); Uramoto et al, "Volume Produced $H^-$, $D^-$ Ion Source for Proton Accelerator and ThermoNuclear Fusion Research by Sheet Plasma (I)", IPPJ-760, January 1986 and (II), IPPJ-789, August 1986; and Leung et al, "Self-extraction Negative Ion Source", Rev. Sci. Instrum., 53, 803 (1982). Although these references deal specifically with the production of $H^-$ and $D^-$ ions, it will be understood that the invention is not limited to the use of any particular type of ion. Thus, any ion source which serves to produce a beam of ions, including anions and cations, may be used for ion source 10 with voltages reversed as required.

Pre-accelerator module 20, which serves as a Pierce gun type structure, takes the circular cylindrical ion beam produced by ion source 10 and accelerates it, for example, to 100 keV, without changing the circular shape of the beam. Pre-accelerator module 20 is also shown and described in more detail in other publications such as, for example, an Anderson et al paper entitled "Accelerator and Transport Systems for High-Current Negative-Ion Beams", presented at the AEA Technical Committee Meeting on Negative Ion Beam Heating at Culman Laboratory on July 15–17, 1987 and published by Lawrence Berkeley Laboratory, Berkeley, CA, as LBL-23748.

Figure 2:
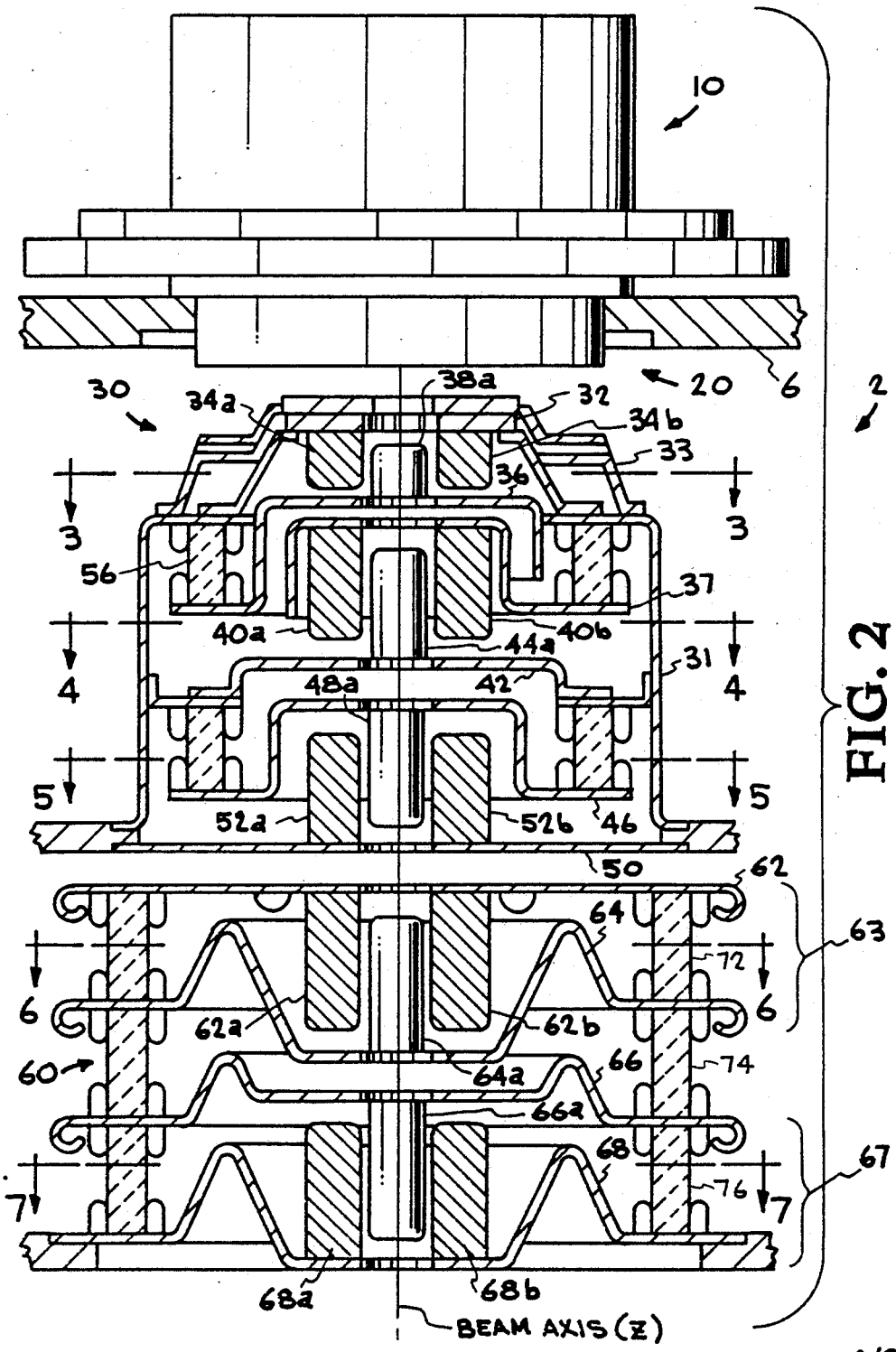
FIG. 2 is a vertical cross-section view of a portion of the structure shown in FIG. 1.

Matching/pumping or transport/pumping module or structure 30, as shown in FIGS. 1 and 2, takes this accelerated beam and focuses it. The focusing is done by changing the shape of the beam from a circular cylinder to an elliptical cylinder of alternating shape. Since the shape of the beam is important to understand in the operation of this embodiment of the invention, it will be further explained. Defining the axis along which the beam travels as z, the beam, as it enters module 30, is cylindrical along the z axis. A cross section of the beam in the x-y plane in pre-accelerator 20 will, therefore define a circle. This cross-section shape, however, is changed to that of an ellipse at certain points along the z axis by matching/pumping structure 30.

This change in the cross-section of the ion beam is achieved, in the embodiment illustrated in FIGS. 1 and 2, by the use of three electrostatic quadrupole (ESQ) focusing electrode units. Each ESQ focusing electrode structure is composed of two plate electrodes disposed in the x-y plane, each having a hole in the center to allow the beam to pass through, and each having two cylindrical projections depending therefrom toward the cylindrical projection depending from the other electrode and disposed parallel to the beam on diametrically opposite sides or positions with respect to the beam path. The two plate electrodes are spaced apart from one another along the z axis of the beam a distance which permits the respective cylindrical projections on the electrode plates to be disposed in interdigited fashion at 90° positions around the beam axis.

Figure 3:
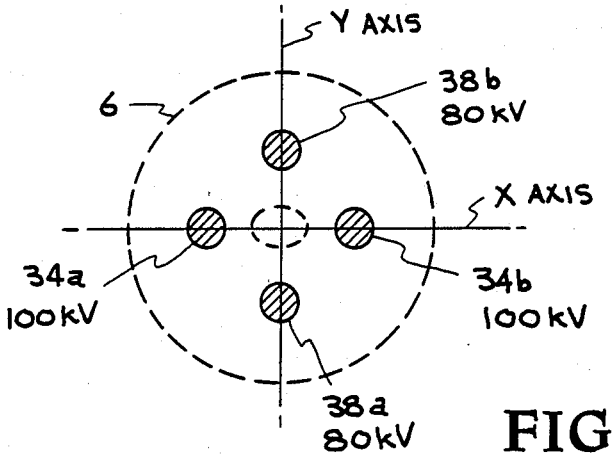
FIG. 3 is a top view of the structure of FIG. 1 taken along lines 3—3 showing the spatial and voltage relationship of the first set of quadrupole electrodes in the matching/pumping module to one another and the shape of the beam under the influence of the electrostatic fields generated by the quadrupole electrodes at that point along the beam path.
Figure 4:
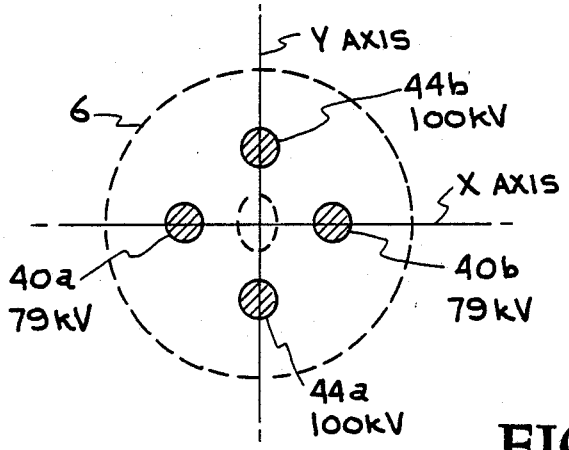
FIG. 4 is a top view of the structure of FIG. 1 taken along lines 4—4 showing the spatial and voltage relationship of the second set of quadrupole electrodes in the matching/pumping module to one another and the shape of the beam under the influence of the electrostatic fields generated by the quadrupole electrodes at that point along the beam path.
Figure 5:
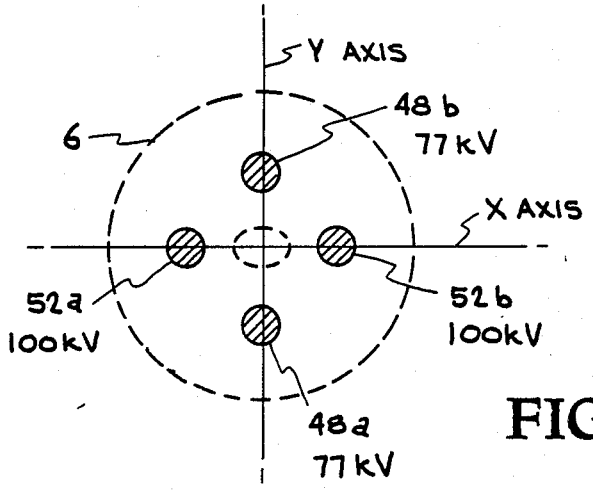
FIG. 5 is a top view of the structure of FIG. 1 taken along lines 5—5 showing the spatial and voltage relationship of the third set of quadrupole electrodes in the matching/pumping module to one another and the shape of the beam under the influence of the electrostatic fields generated by the quadrupole electrodes at that point along the beam path.

Thus, the ESQ structure is achieved by placing the two plate electrodes facing face-to-face, one rotated 90 degrees with respect to the other. The effect of this structure, as seen in FIGS. 3–5, is a quadrupole about the ion beam, which entails four cylindrical electrodes situated in 90 degree intervals with respect to the z axis and equidistant from the z axis. Since the electrodes which oppose each other in the quadrupole are attached to the same plate electrode, they will comprise a set of electrodes at the same potential. If the two sets of cylindrical electrodes are at different potentials, the circular beam will become disfigured, having more affinity toward one set of electrodes than the other.

It should be noted that the more attracting potential is not termed more positive or more negative since this will be a function of the charge on the ions in the beam. Thus, for example, if the beam comprises negatively charged particles, the more attracting potential will be the more positive potential and the beam will be attracted or deflected (expanded) toward the set of electrodes having the more positive potential and repelled (compressed) by the set of electrodes having the less positive potential.

This disfiguration caused, respectively, by the attracting and repelling electrodes of the quadrupole, will change the cross-section of the ion beam to the shape of an ellipse (in the x-y plane). The matching/pumping structure, as seen in FIGS. 1 and 2, has three of these quadrupoles. A focusing effect is achieved when the axis along which the ellipse is elongated alternates between the x-axis and the y-axis with each consecutive quadrupole. This can be clearly seen in FIGS. 3–5, which respectively represent the three quadrupole electrode structures in the matching/pumping module.

The graph of FIG. 10, and the voltages listed in Table I below, illustrate the structure of the invention for a 200 keV beam using only one acceleration module, in addition to the matching/pumping module, in which the beam is accelerated, by increasing the mean potential on each succeeding pair of opposing electrodes in the respective quadrupoles, while still maintaining a suitable alternating orientation of potential differences within each quadrupole, i.e., causing an acceleration of the beam and an increase in its energy, while maintaining alternating elliptical elongations so the beam is focused and the current of the beam can remain constant.

Thus, Table I below lists the respective voltages on the five pairs of opposing cylindrical electrodes in the three quadrupoles of the matching/pumping module and in the two quadrupoles of the single accelerating module of the beam depicted in the graph of FIG. 10.

TABLE I

| Module | Electrodes | Voltage w.r.t. Source (kV) | Voltage w.r.t. Ground (kV) | Focusing Voltage |
|---|---|---|---|---|
| Matching/ | 1a | 100 | −100 | −20 |
| Pumping | 1b | 80 | −120 | |
| | 1c | 79 | −121 | −21 |
| | 1d | 100 | −100 | |
| | 1e | 77 | −123 | −23 |
| | 1f | 100 | −100 | |
| 2 | 2a | 127 | −73 | −23 |
| | 2b | 150 | −50 | |
| | 2c | 186 | −14 | −14 |
| | 2d | 200 | 0 | |

Referring now particularly to FIGS. 1–3, as well as the above Table I, a first electrode plate 32 may, in the illustrated embodiment, be maintained at a positive potential of 100 kV (with respect to the source). Cylindrical electrodes 34*a* and 34*b* (electrodes 1*a* in Table I) depend from electrode plate 32 parallel to the z-axis beam path and form the two opposing electrodes of the first quadrupole maintained at 100 kV. Electrodes 34*a* and 34*b* are depicted in FIG. 3 as having cross-sections along the x-axis.

Spaced and electrically insulated from first electrode plate 32 is a second electrode plate 36, which, in the illustrated embodiment, is shown to be at a potential of 80 keV. Cylindrical electrodes 38*a* and 38*b* (electrodes 1*b* in Table I) depend from electrode plate 36 parallel to the z-axis beam path and in a direction toward first electrode plate 32 to form the other two opposing electrodes of the first quadrupole which then are maintained at 80 kV and which, as shown in FIG. 3, have their cross-sections disposed along the y-axis. As best seen in FIGS. 1 and 2, the spacing between first electrode 32 and second electrode 36 and the respective lengths of the cylindrical electrodes 34*a*, 34*b*, 38*a*, and 38*b* are chosen to provide for the parallel spacing of the cylindrical electrodes and overlap along the z axis to provide the interdigited quadrupole structure illustrated in FIG. 3. As also seen in FIG. 3, the effect on the negatively charged ion beam of the respective charges on electrodes 34*a*, 34*b*, 38*a*, and 38*b* results in the elliptical shape of the beam cross-section shown in FIG. 3, i.e., elongation of the beam along the x axis.

Another electrode plate 37 also provides support for a set of cylindrical electrodes 40*a* and 40*b* (electrodes 1*c* in Table I) which form two of the opposing electrodes of the second quadrupole set as seen in FIGS. 1–2, and 4. Electrodes 40*a* and 40*b* are maintained at a potential of 79 kV.

A fourth electrode plate 42 is also provided in matching/pumping module 30 having a set of cylindrical electrodes 44*a* and 44*b* (electrodes 1*d* in Table I) depending therefrom in the direction of second electrode plate 36 to form, together with cylindrical electrodes 40*a* and 40*b*, the second quadrupole electrode set, as illustrated in FIG. 4, in similar interdigited fashion to that described for the first quadrupole. In the illustrated embodiment, electrode plate 42 is also maintained at 100 kV, i.e., the same potential as first electrode plate 32. As shown in FIG. 4, the shape of the beam is thus transfigured to an ellipse at a 90° orientation to the configuration shown in FIG. 3 by the change in potential of the cylindrical electrodes 40*a*, 40*b*, 44*a*, and 44*b* of the second quadrupole with respect to the potential on electrodes 34*a*, 34*b*, 38*a*, and 38*b* in the first quadrupole electrode structure, i.e., elongation along the y axis.

A fifth electrode plate 46 in matching/pumping module 30 provides cylindrical electrodes 48*a* and 48*b* (electrodes 1*e* in Table I) forming two of the opposing electrodes for the third quadrupole set. Cylindrical electrodes 48*a* and 48*b* are disposed similarly to the previously described cylindrical electrodes with respect to the beam axis. In the illustrated embodiment, and in Table I, electrode plate 46 and cylindrical electrodes 48*a* and 48*b* are maintained at a potential of 77 kV.

The sixth and final electrode plate 50 in matching/pumping module 30 is, in the illustrated embodiment, maintained at a potential of 100 kV, i.e., the same potential as first electrode plate 32 and fourth electrode plate 42. Depending from electrode plate 50, in the direction of fourth electrode plate 42, are cylindrical electrodes 52*a* and 52*b* (electrodes 1*f* in Table I) which are interdigited with cylindrical electrodes 48*a* and 48*b* to form the third quadrupole electrode set, as shown in FIG. 5, in similar fashion to the two previous quadrupole electrode sets just described. The effect of this third quadrupole is simply to change the axis of elongation once again, as seen by the beam shape cross-section in FIG. 5. The purpose of these alternating elongations, termed "matching", is to phase the alternating beam in such a way that the ESQ accelerator can act effectively on the beam (Note that although the shape of the beam has been altered and correctly phased, the energy of the beam is kept approximately constant at 100 keV while in this module).

Electrode plates 32, 36, 37, 42, and 46, and the cylindrical electrodes depending therefrom which comprise matching/pumping module 30, are secured by a metal support cylinder 31 which, in turn, is mounted to a metal electrode plate 50 which extends to housing 6 to which it is insulatively secured. Electrode plate 42 is directly secured to cylinder 31 and thus is maintained at the same potential as electrode plate 50. First electrode plate 32 is directly secured to a tapered portion 33 of cylinder 31 and is, therefore, also maintained at the same potential. Electrode plates 36 and 46, which are maintained at a different potential, are secured to cylinder 31 through insulator rings 56 which are mounted to respective flanges on cylinder 31 and electrode plates 36 and 46.

Vacuum pump means (not shown) may be provided at one or both ends of cylindrical housing means 6 to evacuate from the structure non-ionized gases entering from ion source 10 with the ionized beam. Matching/pumping module 30 is designed to aid in separating such non-ionized gases from the ion beam by the open transparent design (gas transparency) of the electrode support structures which allow the non-ionized gases to expand away from the beam and the electrodes, as shown in FIGS. 1 and 2. Openings (not shown) in the sides of metal support cylinder 31 permit the gas atoms to leave the vicinity of the beam and to enter the larger volume of housing 6 to thereby approach the target vacuum of $10^{-5}$ Torr or less.

In accordance with the invention, the evacuated and matched beam then enters accelerator unit or module 60. In FIG. 1, seven such modules are illustrated, but there is no specific limit to the number of modules which can be used, except possibly for constraints on the total voltage to which the beam may be accelerated based on insulation limitations.

Figure 6:
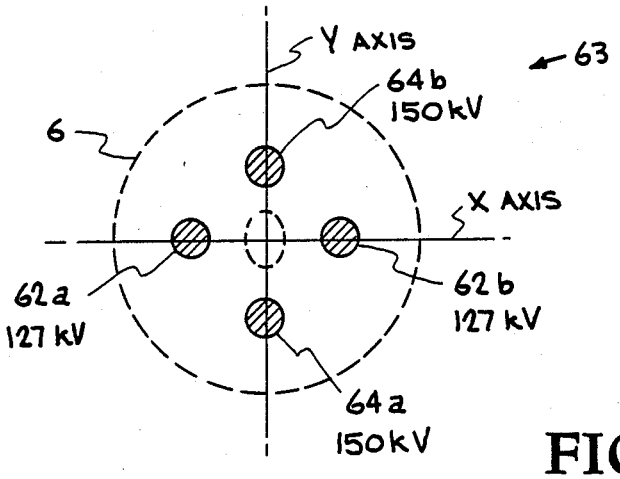
FIG. 6 is a top view of the structure of FIG. 1 taken along lines 6—6 showing the spatial and voltage relationship of the first set of quadrupole electrodes in the accelerator module to one another and the shape of the beam under the influence of the electrostatic fields generated by the quadrupole electrodes at that point along the beam path.

Each accelerator module 60 consists of two ESQ structures comprising cylindrical electrodes such as previously described with respect to the matching-/pumping module 30. Thus, referring to FIGS. 2 and 6–7, and again to Table II, electrode plate 62 has a pair of cylindrical electrodes **62*a* and 62*b*** (electrodes *2a* in Table I) depending therefrom parallel to and spaced from the beam axis. The cylindrical electrodes **62*a* and 62*b* extend in a direction toward the second electrode plate 64 in module 60 from which cylindrical electrodes 64*a* and 64*b*** (electrodes *2b* in Table I) depend parallel to and spaced from the beam axis in a direction toward electrode plate 62 so that electrodes **62*a* and 62*b* are interdigited with electrodes 64*a* and 64*b* to provide a first electrostatic quadrupole (ESQ) electrode focusing and accelerating lens structure 63 as shown in FIG. 6**.

Figure 7:
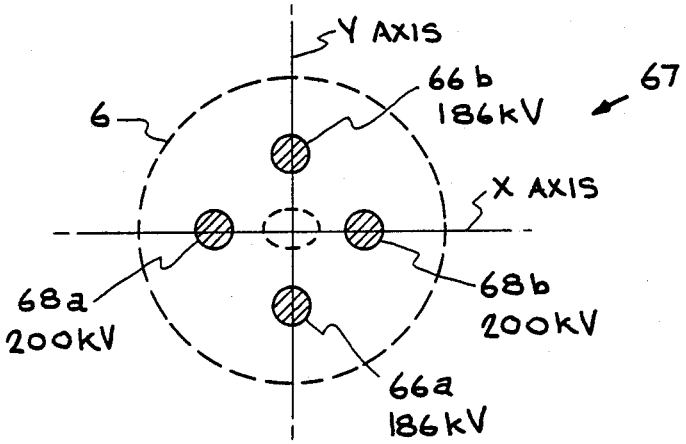
FIG. 7 is a top view of the structure of FIG. 1 taken along lines 7—7 showing the spatial and voltage relationship of the second set of quadrupole electrodes in the accelerator module to one another and the shape of the beam under the influence of the electrostatic fields generated by the quadrupole electrodes at that point along the beam path.

A third electrode plate 66 is similarly provided with a pair of cylindrical electrodes **66*a* and 66*b*** (electrodes *2c* in Table I) depending therefrom parallel to and spaced from the beam axis and extending in a direction toward a fourth electrode plate 68 in module 60 from which cylindrical electrodes **68*a* and 68*b*** (electrodes *2d* in Table I) depend parallel to and spaced from the beam axis in a direction back toward electrode plate 66 so that electrodes **68*a* and 68*b* are interdigited with electrodes 66*a* and 66*b* to provide a second electrostatic quadrupole (ESQ) electrode focusing and accelerating lens structure 67 of accelerating module 60 as shown in FIG. 7**.

The four electrode plates are electrically separated from one another respectively by insulating washers 72, 74, and 76 which, like insulators 56, may comprise any suitable insulating material such as a ceramic, an epoxy material, or Torlon, a polyamide-imide material available from the Polymer Corp., and which also provide mechanical support for electrode plates 62–66. Electrode plate 68 extends out to the wall of cylindrical housing 6 to which it is insulatively mounted. Independent electrical connection to each electrode plate is made through connection means (not shown) which permits each electrode to be maintained at a separate voltage to provide the desired acceleration of the beam without loss of current as will be described below.

Thus, the ESQ structure of the invention with an electrically independent support structure for each pair of electrodes in each quadrupole allows independent control of focusing and acceleration voltages. This is a key to the constant-current variable voltage (CCVV) accelerator of the invention, in operation, in modularity, and to flexibility in terms of overall length. The acceleration channel may be lengthened to match the length of the graded insulating column, as in FIG. 1. This, in turn, reduces internal gradients and the solid angle accessible for voltage breakdown mechanisms. The ESQ focusing forces also help to avoid breakdown by sweeping out most undesired particles transversely.

Figure 8:
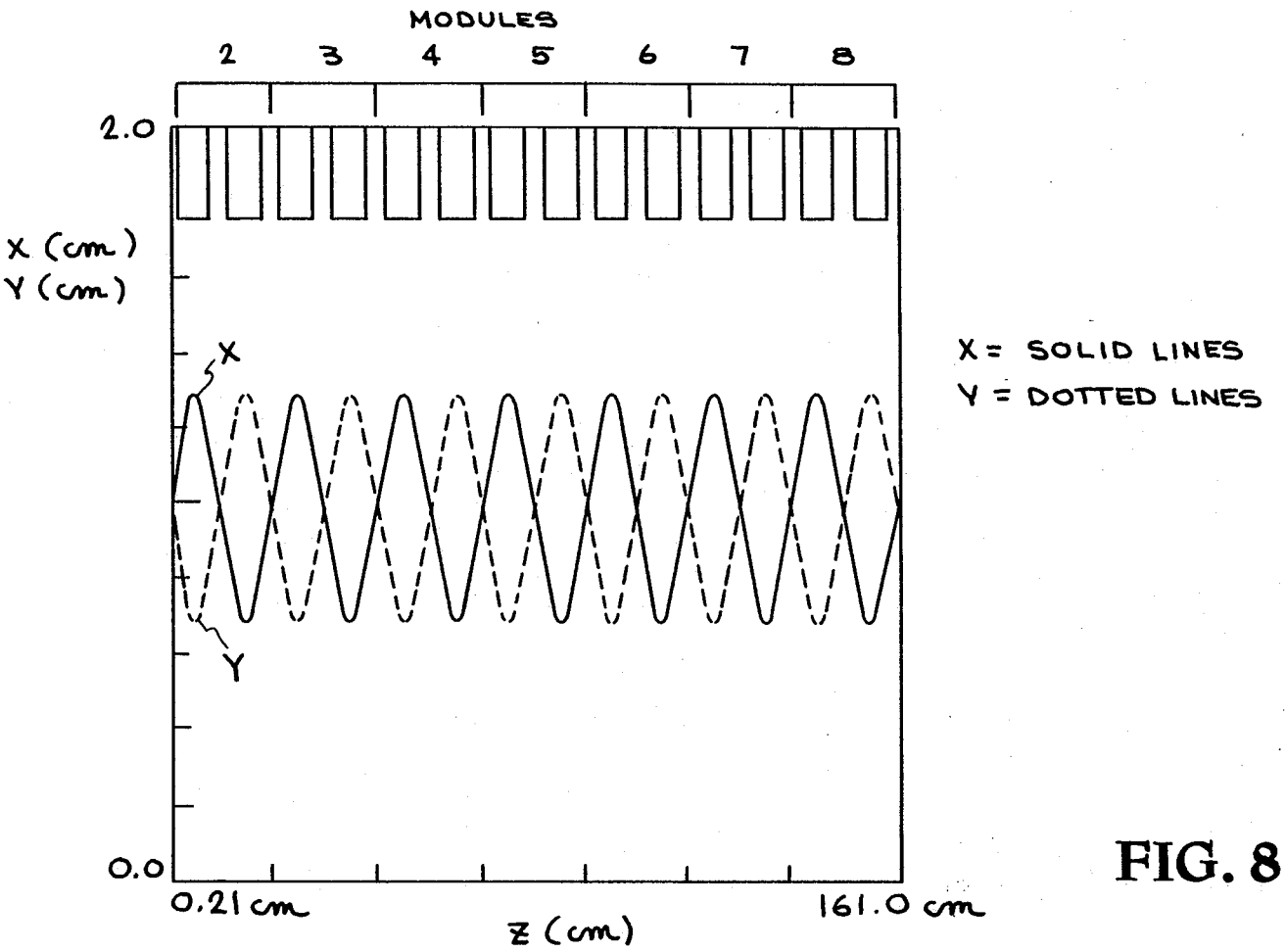
FIG. 8 is a graph illustrating the X and Y axes of the beam path when the quadrupole electrodes in each module are maintained at voltages which do not accelerate the beam but merely maintain focus.

Referring to the graph of FIG. 8, operation of the accelerator structure of the invention with a series of seven accelerator modules 60 is illustrated in a simple nonaccelerating mode which merely maintains focus of the beam by alternating the charge on the opposing quadrupole electrodes. Thus, if the charge on cylindrical electrodes **62*a* and 62*b* along the x-axis in first ESQ structure 63 of each module is 92 kV and the charge on cylindrical electrodes 64*a* and 64*b* along the y-axis in first ESQ structure 63 of each module is 108kV, and the opposite occurs in second ESQ structure 67 of each module, that is, cylindrical electrodes 66*a* and 66*b* along the x-axis are at 108 kV and cylindrical electrodes 68*a* and 68*b* along the y-axis are at 92 kV in the second ESQ structure of each module, then the shape of the beam will be periodic (repeating) with each module as shown in FIG. 8**.

The solid line in the graph of FIG. 8 represents the distance of the beam from the z-axis in the x direction and the dotted line represents the distance of the beam from the z-axis in the y direction. Each maximum in the x direction and minimum in the y direction represents the center (along the z axis) of first ESQ electrode structure 63 in each module. The minimum in the x direction and the maximum in the y direction represents the center (along the z axis) of each second ESQ electrode structure 67 in each accelerating module 60. Since each set of two ESQ structures (63 and 67) represents a module, and since the beam shape is identical and repeating with every two ESQ structures, the beam, in this case, is periodic with every module, illustrating the matched phasing of the beam discussed earlier.

This example is merely the most simple situation using the accelerator. Since one pair of opposing electrodes in each quadrupole electrode structure is at 92 kV and the other pair of opposing electrodes is at 108 kV, the average energy of the beam would be 100 keV, which is the same as its initial energy upon entering the accelerator unit.

Figure 9:
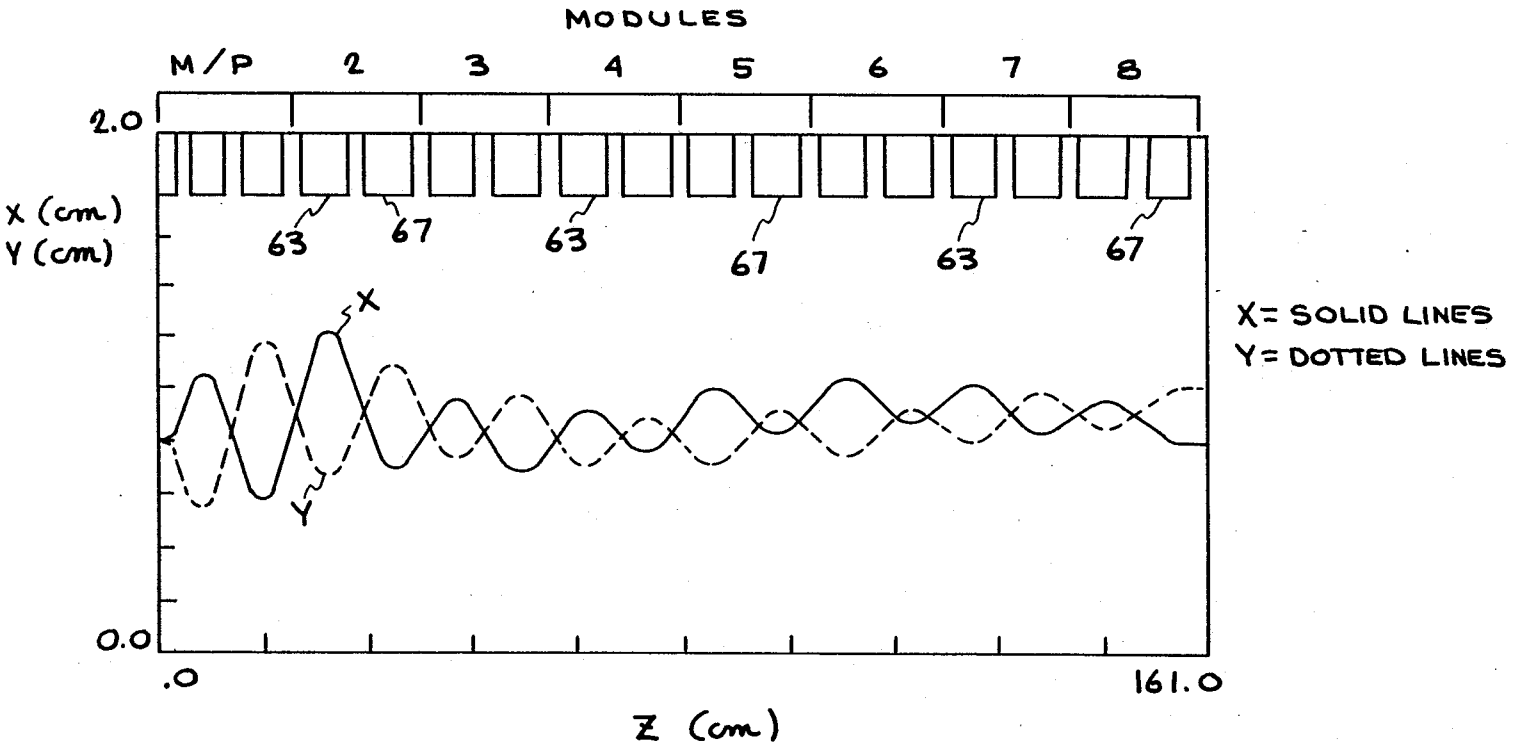
FIG. 9 is a graph illustrating the X and Y axes of the beam path when the quadrupole electrodes in each module are maintained at a higher voltage than the corresponding electrodes in a preceding module for an 800 keV beam using seven accelerating modules in addition to the matching/pumping module.

The graph of FIG. 9 illustrates a more typical situation in which the beam is accelerated, by increasing the mean potential on each succeeding pair of opposing electrodes in the respective quadrupoles, while still maintaining a suitable alternating orientation of potential difference within each quadrupole, causing an acceleration of the beam and an increase in its energy, while maintaining alternating elliptical elongations so the beam is focused and the current of the beam can remain constant.

By way of example, the profile shown in FIG. 9 is that needed to accelerate an H- beam to an energy of 800 keV. For such a desired output, Table II below lists the respective voltages on the four pairs of opposing cylindrical electrodes in the two quadrupoles comprising each accelerating module where seven such modules are employed as depicted in FIG. 1 and shown in the graphs of FIGS. 8 and 9. The voltages on the electrodes of the three quadrupoles comprising matching-/pumping module 30 are also shown in Table II.

The representative voltages applied to the respective electrodes listed in Table II may be supplied to the electrodes via a plurality of variable power supplies 70, by way of example only, as shown in FIG. 1. Alternatively, a single power supply with individual variable resistors might also be used to provide independent power to each electrode pair. The connection to each of the electrodes from power supplies 70 is not shown to simplify the drawing.

For each module the opposing cylindrical electrode pairs are noted in Table II as a, b, c, and d. It will be understood that the first two electrode pairs correspond, respectively, to cylindrical electrode pairs 62*a*, 62*b* and 64*a*, 64*b* (quadrupole 63) while the second two electrode pairs correspond, respectively to 66*a*, 66*b* and 68*a*, 68*b* (quadrupole 67) previously described. The source voltages listed for the seven accelerating modules are the voltages, in kilovolts, with respect to the source, i.e., the beam energy as it enters the first accelerating module from the matching/pumping module, which, in this case is 100 keV. The focusing voltage listed represents the difference in the voltages of the opposing pairs of electrodes in each quadrupole electrode structure, resulting in the ellipsoidal shape of the beam in each quadrupole.

TABLE II

| Module | Electrode | Voltage w.r.t. Source (kV) | Voltage w.r.t. Ground (kV) | Focusing Voltage |
|---|---|---|---|---|
| Matching/ | 1a | 100 | −700 | −20 |
| Pumping | 1b | 80 | −720 | |
| | 1c | 80 | −720 | 20 |
| | 1d | 100 | −700 | |
| | 1e | 79 | −721 | 21 |
| | 1f | 100 | −700 | |
| 2 | 2a | 128 | −672 | 22 |
| | 2b | 150 | −650 | |
| | 2c | 178 | −622 | 22 |
| | 2d | 200 | −600 | |
| 3 | 3a | 227 | −573 | 23 |
| | 3b | 250 | −550 | |
| | 3c | 275 | −525 | 25 |
| | 3d | 300 | −500 | |
| 4 | 4a | 325 | −475 | 25 |
| | 4b | 350 | −450 | |
| | 4c | 374 | −426 | 26 |
| | 4d | 400 | −400 | |
| 5 | 5a | 421 | −379 | 29 |
| | 5b | 450 | −350 | |
| | 5c | 469 | −331 | 31 |
| | 5d | 500 | −300 | |
| 6 | 6a | 519 | −281 | 31 |
| | 6b | 550 | −250 | |
| | 6c | 571 | −229 | 29 |
| | 6d | 600 | −200 | |
| 7 | 7a | 618 | −182 | 32 |
| | 7b | 650 | −150 | |
| | 7c | 666 | −134 | 34 |
| | 7d | 700 | −100 | |
| 8 | 8a | 719 | −81 | 31 |
| | 8b | 750 | −50 | |
| | 8c | 784 | −16 | 16 |
| | 8d | 800 | 0 | |

While Table II shows the voltages used on each quadrupole electrode for accelerating the beam using seven acceleration modules to accelerate the beam up to an energy level of 800 keV, as opposed to the single acceleration module used in Table I to accelerate the beam to 200 keV, it will be understood that the modular structure of the invention with separate electrical attachment or connection to each quadrupole electrode permits variations in beam output energy to be accomplisted either by varying the number of acclerating modules used or by varying the potential applied to the electrodes to thereby vary the amount of acceleration provided by each module. Table III below illustrates three cases where the same number of modules (seven in addition ot the transport/matching module) are used but the exit energy from each module is varied by changing the quadrupole electrode voltages rather than changing the number of modules. In the first instance, the beam energy is raised by approximately 100 keV per module, while in the second case the energy level is raised by approximately 50 keV per module. In the third case shown in Table III, the beam energy is matained constant over all seven acceleration modules.

TABLE III

| | Beam Current Fixed at 200 mA of $H^-$ Beam Energy Variable Between 100 keV and 800 keV | | | | | | | |
|---|---|---|---|---|---|---|---|---|
| Module I.D. | Transport/ Matching | 2 | 3 | 4 | 5 | 6 | 7 | Exit Module |
| Module Exit Energy (keV) | 100 | 200 | 300 | 400 | 500 | 600 | 700 | 800 |
| Quad kilovolts | | 18 | 20 | 22 | 24 | 27 | 30 | 15 |
| Module Exit Energy (keV) | 100 | 150 | 200 | 250 | 300 | 350 | 400 | 450 |
| Quad kilovolts | | 18 | 19 | 20 | 21 | 22 | 24 | 12 |
| Module Exit Energy (keV) | 100 | 100 | 100 | 100 | 100 | 100 | 100 | 100 |
| Quad kilovolts | | 18 | 18 | 18 | 18 | 18 | 18 | 18 |

The module voltages are given as kilovolts relative to the source.
The quad voltages are kilovolts between the electrodes.

Figure 10:
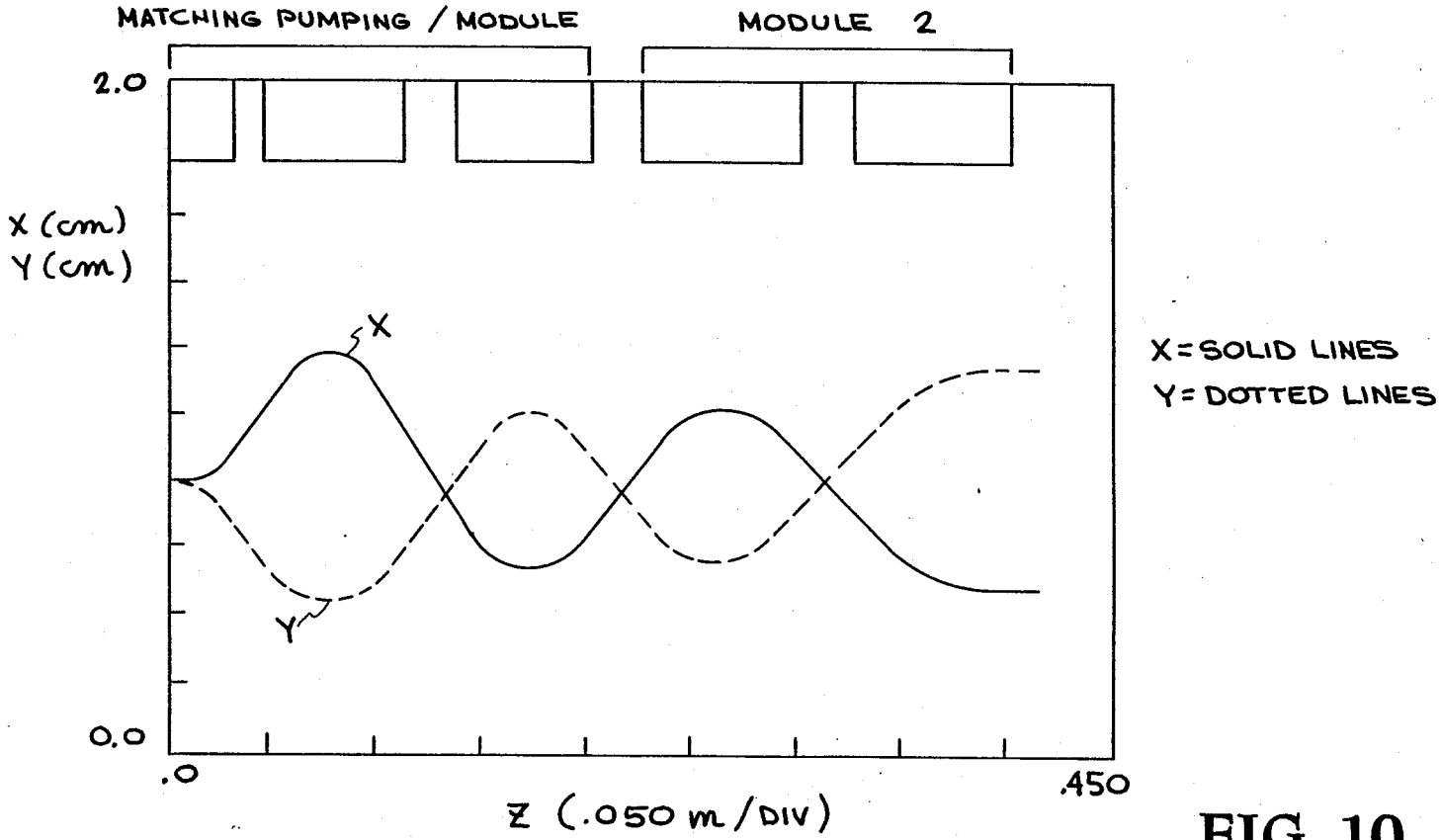
FIG. 10 is a graph illustrating the X and Y axes of the beam path when the quadrupole electrodes in each module are maintained at a higher voltage than the corresponding electrodes in a preceding module for a 200 keV beam using one accelerating module in addition to the matching/pumping module.

Thus, the key aspect to the invention, as shown in FIGS. 9 and 10, and in Tables I–III, is that the accelerator structure can be used to generate constant current ion beams at variable output voltages. Either the voltage profiles on the quadrupole electrodes can be changed or the number of accelerator modules utilized can be varied (or both may be changed) to vary the output energy of the beam to that desired for the particular application, e.g., for ion implantation in semiconductors using various energy levels. Furthermore, the upper level of the beam energy is limited only by the voltages at which the system is operated and the voltage source.

Figure 11:
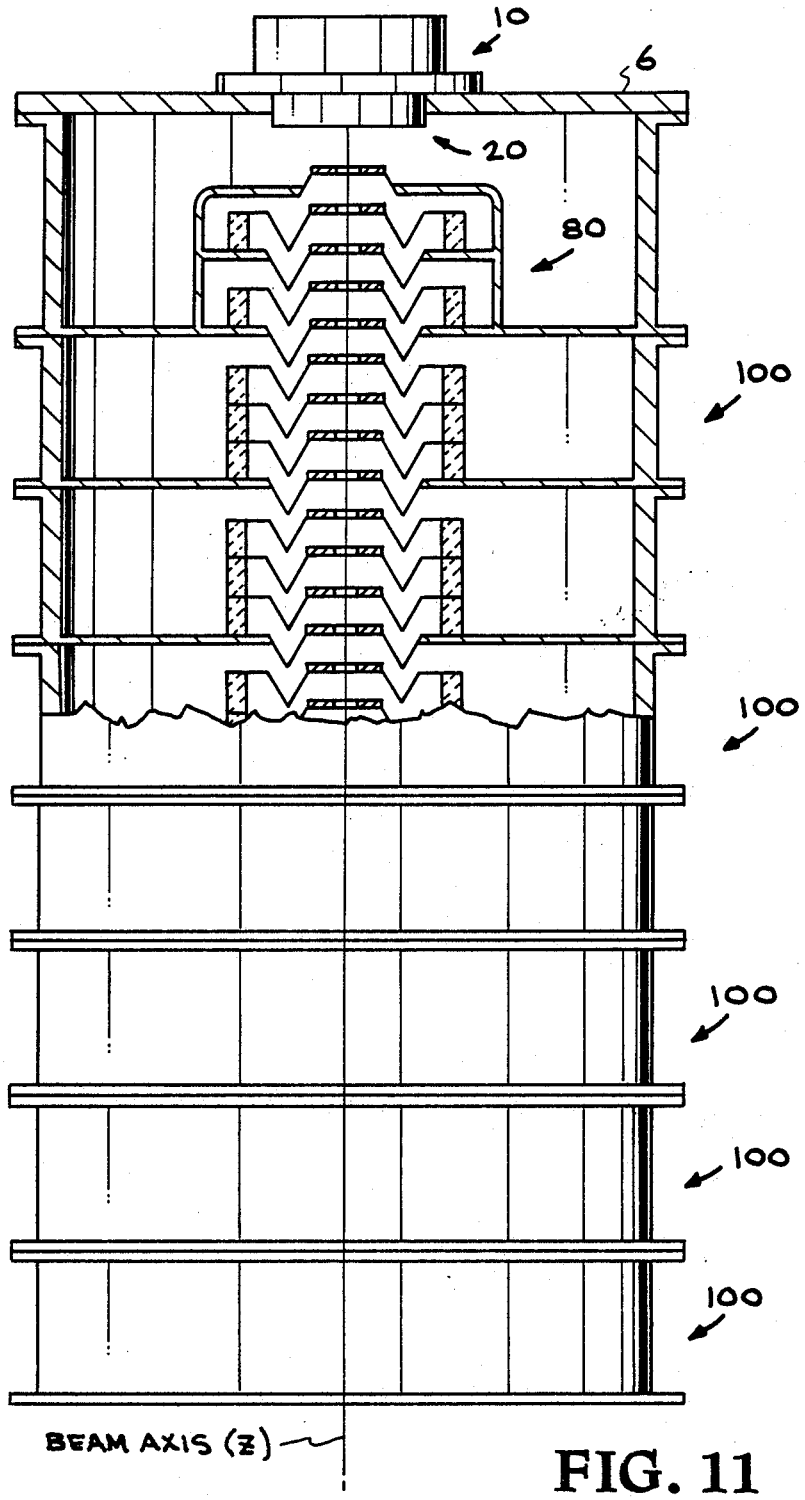
FIG. 11 is a vertical cross-section view of a another embodiment of the variable energy accelerator of the invention constructed using electrostatic ring focusing and accelerating electrodes.
Figure 12:
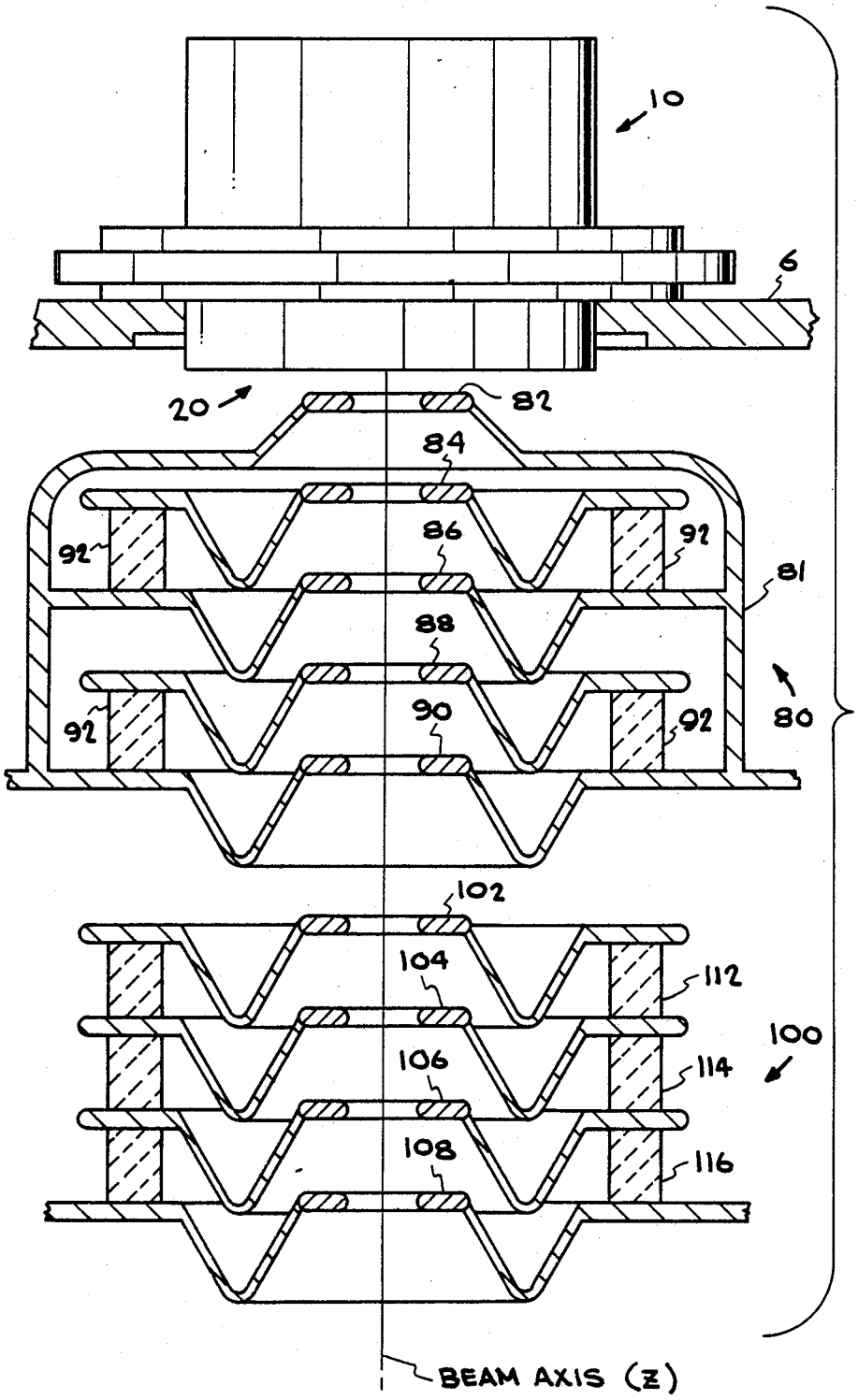
FIG. 12 is a vertical cross-section view of a portion of the structure shown in FIG. 11.

Turning now to FIGS. 11 and 12, another embodiment of the invention is illustrated wherein the quadrupole electrode structure utilized in both the matching/pumping module and the accelerator modules of the previous embodiment are replaced with an electrostatic ring electrode structure termed an electrostatic ring (ESR) focused variable energy accelerator. The same ion source 10 and preaccelerator module or Pierce gun 20 may be used in this embodiment as well.

The function of the ESR type accelerator is similar to that of the preferred embodiment using ESQ; the difference is that instead of using quadrupole electrodes to focus the beam, ring electrodes are used. Because each electrode is a ring, the electrostatic field around the beam at each ring electrode is homogeneous with respect to the z-axis. As a result, the beam has a circular cross section in the x-y plane.

The way that the ring electrode structure achieves its focusing effect is through alternating increased and decreased ring potentials. For example, in FIG. 11, when a beam at an energy of −100 keV enters structure 80 (analogous to matching/pumping structure 30 of the ESQ-type accelerator and hereinafter referred to as transport module 80) from pre-accelerator module 20, a first ring electrode 82 in transport module 80 may be operated at a potential of −100 kV. A second ring electrode 84 in transport module 80 is maintained at a potential of −120 kV, a third ring 86 at a potential of −100 kV, a fourth ring 88 at a potential of −176 kV, and a last ring electrode 90 at a potential of −100 kV. Electrode rings 82, 86, and 90, respectively, are attached to cylinder 81. Rings 84 and 88 are insulatively secured to cylinder 81. This structure provides for rings 82, 86, and 90 to each have the same potential, whereas 84 and 88 can be at potentials different from the aforementioned rings and independent of each other. This technique achieves focusing by causing the cross-sectional circular region to increase and decrease in size between rings. As with the ESQ embodiment, transport module 80 focuses the beam, but does not change the energy from 100 keV.

The beam then passes into accelerator unit or module 100, where it is accelerated in a way analogous to ESQ accelerator 60. An important note, referring again to FIGS. 11 and 12, is that each module in the ESR accelerator structure contains four rings 102, 104, 106, and 108 respectively. Rings 102 and 104 are separated by insulator 112. Similarly, rings 104 and 106 are separated by insulaor 114, and rings 106 and 108 are separated by insulator 116. The acceleration which would take place in the specific embodiment in FIG. 12 also maintains the increasing and dereasing in radius of the cross sectional circle of the charged particle beam as the potential on the ring electrodes typically change from −138 kV at ring electrode 102 to −50 kV at ring 104 to −88 kV at ring 106 to 0 at ring 108. This slight decrease and large increase, repeated by another slight decrease and large increase in potential allows for the beam to be focused through an increase and decrease in cross sectional radius, as well as allowing the beam to be accelerated, or increased in energy since there is an overall trend of increasing potential. The end effect of this is the same as the effect using ESQ: the beam can be accelerated (according to the potential of the rings) while maintaining a constant current.

Thus, the invention provides an improved charged particle beam accelerator wherein constant current may be maintained in the ion beam while varying the output energy of the ion beam using modular or stackable accelerating electrode units. While specific embodiments of the variable energy constant current accelerator structure of the invention have been illustrated and described for carrying out the formation and operation of the accelerator structure in accordance with this invention, modifications and changes of the apparatus, parameters, materials, etc. will become apparent to those skilled in the art, and it is intended to cover in the appended claims all such modifications and changes which come within the scope of the invention.

What is claimed is:

1. A variable energy, constant current charged particle beam accelerator structure comprising an ion source capable of providing the desired ions for an ion beam, a pre-accelerator for establishing an initial energy level of said ion beam, a matching/pumping module having means for focusing and means for maintaining the beam current, and at least one main accelerator module for continuing beam focus comprising four electrically isolated spaced apart electrode structures disposed along the axis of beam travel, each having a beam passageway defined therein and each maintainable at different voltages to maintain the beam focus as said ion beam travels through said passageways, so that a constant beam output current is maintained independent of the variable output energy.

2. The variable energy, constant current charged particle beam accelerator structure of claim 1 wherein said at least one main accelerator module comprises a plurality of said modules with identical physical structures which have been incrementally added to achieve a desired maximum output energy.

3. The variable energy, constant current charged particle beam accelerator structure of claim 2 wherein each of said electrically isolated electrode structures in said main accelerator module comprises an element having a central ring portion disposed substantially normal to the beam axis and parallel to one another.

4. The variable energy, constant current charged particle beam accelerator structure of claim 3 wherein a pair of cylindrical electrodes on a first of said ring electrodes are disposed parallel to said beam axis extending respectively on opposite sides of said beam toward a second of said ring electrodes, and said second ring electrode is also provided with a pair of cylindrical electrodes thereon disposed parallel to said beam axis and extending respectively on opposite sides of said beam back toward said first electrode ring with said cylindrical electrodes on said first ring electrode and said cylindrical electrodes on said second ring electrode disposed at 90° intervals from one another around said beam axis and the length of said cylindrical electrodes and the spacing between said first and second ring electrodes permitting said cylindrical electrodes to be disposed in interdigited fashion to form a quadrupole electrode structure around said beam axis.

5. The variable energy, constant current charged particle beam accelerator structure of claim 4 wherein third and fourth ring electrodes of said accelerator module are provided with cylindrical eledrodes similar to those provided on said first and second electrode rings to thereby form a second quadrupole electrode structure spaced along the beam axis from said first quadrupole electrode structure.

6. The variable energy, constant current charged particle beam accelerator structure of claim 5 wherein different potentials are respectively applied to said cylindrical electrodes depending respectively from said first and second ring electrodes to cause the cross-section of said beam to define an ellipse at the midpoint along said first quadrupole electrode structure.

7. The variable energy, constant current charged particle beam accelerator structure of claim 6 wherein different potentials are respectively applied to said cylindrical electrodes depending respectively from said third and fourth ring electrodes to cause the cross-section of said beam to define an ellipse at the midpoint along said second quadrupole electrode structure which is rotated 90° to said ellipse in said first quadrupole to maintain the focus of said beam.

8. The variable energy, constant current charged particle beam accelerator structure of claim 7 wherein the potentials respectively applied to said cylindrical electrodes depending respectively from said third and fourth ring electrodes are higher than the potentials applied to the cylindrical electrodes depending from said first and second electrode rings whereby the energy potential of said charged particle beam is increased as said beam travels through said first and second quadrupole electrode structures while the focus of said beam is maintained to keep the beam current constant.

9. The variable energy, constant current charged particle beam accelerator structure of claim 8 wherein said structure comprises a plurality of said accelerator modules, each having quadrupole electrode structures with the potentials respectively applied to said cylindrical electrodes of said quadrupoles progressively increasing along the beam axis to accelerate said beam to a predetermined energy level while maintaining constant current and focus of said beam.

10. The variable energy, constant current charged particle beam accelerator structure of claim 3 wherein said ring electrodes in said accelerator module are maintained at potentials which alternatively expand and compress the cross-section of said beam to maintain the focus of said beam.

11. The variable energy, constant current charged particle beam accelerator structure of claim 10 wherein the potentials on said ring electrodes in said accelerator module are maintained in a gradually ascending mode while alternatively expanding and compressing the cross-section of said beam to maintain the focus of said beam while gradually increasing the energy level of said beam.

12. The variable energy, constant current charged particle beam accelerator structure of claim 11 wherein the potentials on said ring electrodes in said accelerator module are maintained in a gradually ascending mode while alternatively expanding and compressing the cross-section of said beam by providing a lower potential on a second of said electrode rings than the potential on the first of said electrode rings, providing a potential on a third of said electrode rings higher than the potential on either the first or second of said electrode rings, and further providing a potential on a fourth of said electrode rings higher than the potential on said second electrode ring but lower than the potential on said third electrode ring, whereby the focus of said beam is maintained and the current is maintained constant by alternatively expanding and compressing the cross-section of said beam while gradually increasing the energy level of said beam.

13. The variable energy, constant current charged particle beam accelerator structure of claim 12 wherein said structure comprises a plurality of said accelerator modules, each having said ring electrode structures with the potentials respectively applied to said electrodes progressively increasing alternatively along the beam axis to accelerate said beam to a predetermined energy level while maintaining constant current and focus of said beam.

14. A variable energy, constant current charged particle beam accelerator structure comprising an ion source capable of providing the desired ions for an ion beam, a pre-accelerator for establishing an initial energy level of said ion beam, a matching/pumping module having means for focusing and means for maintaining the beam current, and at least one main accelerator module for continuing beam focus, with means capable of variably imparting acceleration to the beam so that a constant beam output current is maintained independent of the variable output energy comprising one or more accelerator modules each comprising four electrically isolated spaced apart electrode structures disposed along the axis of beam travel, each having a beam passageway defined therein and each maintainable at different voltages to maintain the beam focus as said ion beam travels through said passageways, each of said electrodes comprising a central ring portion disposed normal to the beam axis and parallel to one another, a pair of cylindrical electrodes on a first of said ring electrodes disposed parallel to said beam axis extending respectively on opposite sides of said beam toward a second of said ring electrodes, said second ring electrode is also provided with a pair of cylindrical electrodes thereon disposed parallel to said beam axis and extending respectively on opposite sides of said beam back toward said first electrode ring with said cylindrical electrodes on said first ring electrode and said cylindrical electrodes on said second ring electrode disposed at 90° intervals from one another around said beam axis and the length of said cylindrical electrodes and the spacing between said first and second ring electrodes permitting said cylindrical electrodes to be disposed in interdigited fashion to form a first quadrupole electrode structure around said beam axis, and third and fourth ring electrodes of said accelerator module provided with cylindrical electrodes similar to those provided on said first and second electrode rings to thereby form a second quadrupole electrode structure spaced along the beam axis from said first quadrupole electrode structure.

* * * * *